US011933300B2

(12) United States Patent
Tanimoto et al.

(10) Patent No.: US 11,933,300 B2
(45) Date of Patent: Mar. 19, 2024

(54) SCREW COMPRESSOR HAVING A SCREW ROTOR WHOSE PITCH CHANGES IN AN AXIAL DIRECTION FROM A SUCTION END SURFACE TOWARD A DISCHARGE END SURFACE

(71) Applicant: Hitachi Industrial Equipment Systems Co., Ltd., Tokyo (JP)

(72) Inventors: Shota Tanimoto, Tokyo (JP); Shigeyuki Yorikane, Tokyo (JP); Tomohiro Komatsu, Tokyo (JP); Takeshi Tsuchiya, Tokyo (JP); Kotaro Chiba, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 17/760,790

(22) PCT Filed: Sep. 10, 2020

(86) PCT No.: PCT/JP2020/034297
§ 371 (c)(1),
(2) Date: Mar. 16, 2022

(87) PCT Pub. No.: WO2021/070548
PCT Pub. Date: Apr. 15, 2021

(65) Prior Publication Data

US 2022/0341423 A1 Oct. 27, 2022

(30) Foreign Application Priority Data

Oct. 7, 2019 (JP) ..... 2019-184225

(51) Int. Cl.
*F04C 18/16* (2006.01)
*F04C 29/00* (2006.01)
*F04C 29/02* (2006.01)

(52) U.S. Cl.
CPC ..... *F04C 18/16* (2013.01); *F04C 29/0007* (2013.01); *F04C 29/02* (2013.01); *F04C 2250/20* (2013.01)

(58) Field of Classification Search
CPC ..... F04C 2/16; F04C 18/16; F04C 15/0088; F04C 15/0092; F04C 29/0007;
(Continued)

(56) References Cited

U.S. PATENT DOCUMENTS 3,424,373 A * 1/1969 Gardner ..... F04C 18/16 418/201.1
3,807,911 A 4/1974 Caffrey
(Continued)

FOREIGN PATENT DOCUMENTS

CN 112814900 A * 5/2021 ..... F04C 18/16
JP 52-142217 U 10/1997
(Continued)

OTHER PUBLICATIONS

International Search Report of PCT/JP2020/034297 dated Nov. 2, 2020.
(Continued)

*Primary Examiner* — Laert Dounis
(74) *Attorney, Agent, or Firm* — MATTINGLY & MALUR, PC

(57) ABSTRACT

This screw compressor is provided with a screw rotor, a casing accommodating the screw rotor, and a liquid feed mechanism for feeding a liquid into an operating chamber enclosed by the casing, wherein the pitch of the screw rotor
(Continued)

changes in the axial direction from a suction end surface toward a discharge end surface.

9 Claims, 16 Drawing Sheets

(58) Field of Classification Search
CPC ..... F04C 29/0014; F04C 29/02–028; F04C 29/042; F01C 1/16
See application file for complete search history.

(56) References Cited

U.S. PATENT DOCUMENTS 6,514,035 B2 * 2/2003 Iwane ..... F04D 19/044 415/72
2005/0244294 A1 11/2005 Murakami et al.
2010/0086883 A1 * 4/2010 Zollig ..... F04C 29/0092 431/12
2019/0170143 A1 6/2019 Chiba et al.

FOREIGN PATENT DOCUMENTS

| | | | | |
|---|---|---|---|---|
| JP | 2001-153073 | A | | 6/2001 |
| JP | 2005-315149 | A | | 11/2005 |
| JP | 2018-197531 | A | | 12/2018 |
| JP | 2018197531 | A | * | 12/2018 |
| KR | 101450507 | B1 | * | 10/2014 |
| WO | 2018/038070 | A1 | | 3/2018 |

OTHER PUBLICATIONS

Written Opinion of the International Searching Authority dated Nov. 2, 2020, corresponds to PCT/JP2020/034297.

* cited by examiner

SCREW COMPRESSOR HAVING A SCREW ROTOR WHOSE PITCH CHANGES IN AN AXIAL DIRECTION FROM A SUCTION END SURFACE TOWARD A DISCHARGE END SURFACE

TECHNICAL FIELD

The present invention relates to a liquid feed type screw compressor.

BACKGROUND ART

As screw compressors, there is known a screw compressor which is driven while feeding a liquid to an operating chamber. It is known that a screw rotor is lubricated and a working fluid is cooled and suppressed from leaking by the feeding of the liquid. On the other hand, since the rotating screw rotor requires power for carrying the fed liquid to a discharge port, the energy-saving performance of the compressor is reduced.

As an example of measures to increase power, Patent Document 1 describes an oil feed type screw compressor which improves cooling efficiency by efficiently diffusing fed oil, efficiently cools compressed air by injecting a small amount of oil, and reduces oil stirring loss of the screw rotor.

Further, in the case of feeding a liquid by a general differential pressure, there is a limitation that a position that a liquid feed port can be installed is limited to a place in which the liquid feed port communicates with the operating chamber whose pressure is lower than a main liquid feeding pressure. In addition, since it is necessary to set a sufficiently large pressure difference between the main liquid feeding pressure and the pressure of the operating chamber communicating with the liquid feed port in order to satisfy the required liquid feeding amount, the installable range of the liquid feed port is limited.

CITATION LIST

Patent Document

Patent Document 1: JP 2001-153073 A

SUMMARY OF THE INVENTION

Problems to be Solved by the Invention

In the liquid feed type screw compressor, since the minimum liquid feeding amount required to lubricate the screw rotor is fixed, there is a limitation in reducing the stirring loss by the method of reducing the liquid feeding amount as described in Patent Document 1. Here, the measure of approaching the liquid feed port to the discharge port is effective in order to reduce the stirring loss without changing the liquid feeding amount, but there is a problem that the installable range of the liquid feed port is limited.

Further, since the screw rotor or the casing is miniaturized and the installable range of the liquid feed port is decreased due to the high-speed and miniaturized compressor in recent years, there is a problem that the degree of freedom in designing the number of liquid feed ports to be installed, the installation location, and the like is reduced.

Here, the present inventors have found that the installable range of the liquid feed port can be expanded when the pitch of the screw rotor changes.

An object of the invention is to provide a screw compressor which expands an installable range of a liquid feed mechanism.

Solutions to Problems

As a preferred example of the invention, provided is a screw compressor including: a screw rotor; a casing which accommodates the screw rotor; and a liquid feed mechanism which feeds a liquid into an operating chamber enclosed by the casing, wherein a pitch of the screw rotor in an axial direction changes from a suction end surface toward a discharge end surface.

Effects of the Invention

According to the invention, it is possible to expand the installable range of the liquid feed mechanism.

MODE FOR CARRYING OUT THE INVENTION

Figure 2:
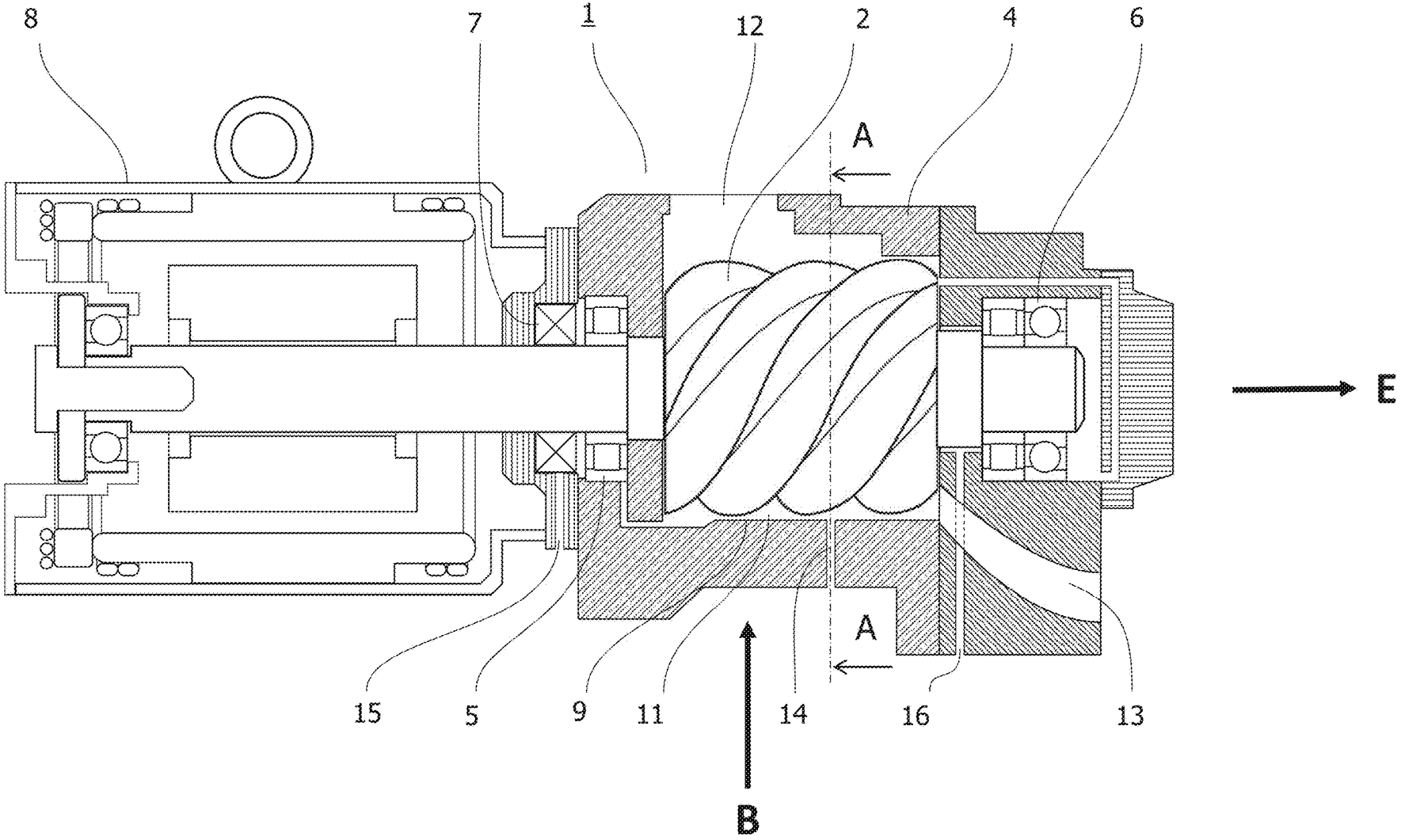
FIG. 2 is a configuration diagram of a screw compressor.
Figure 3:
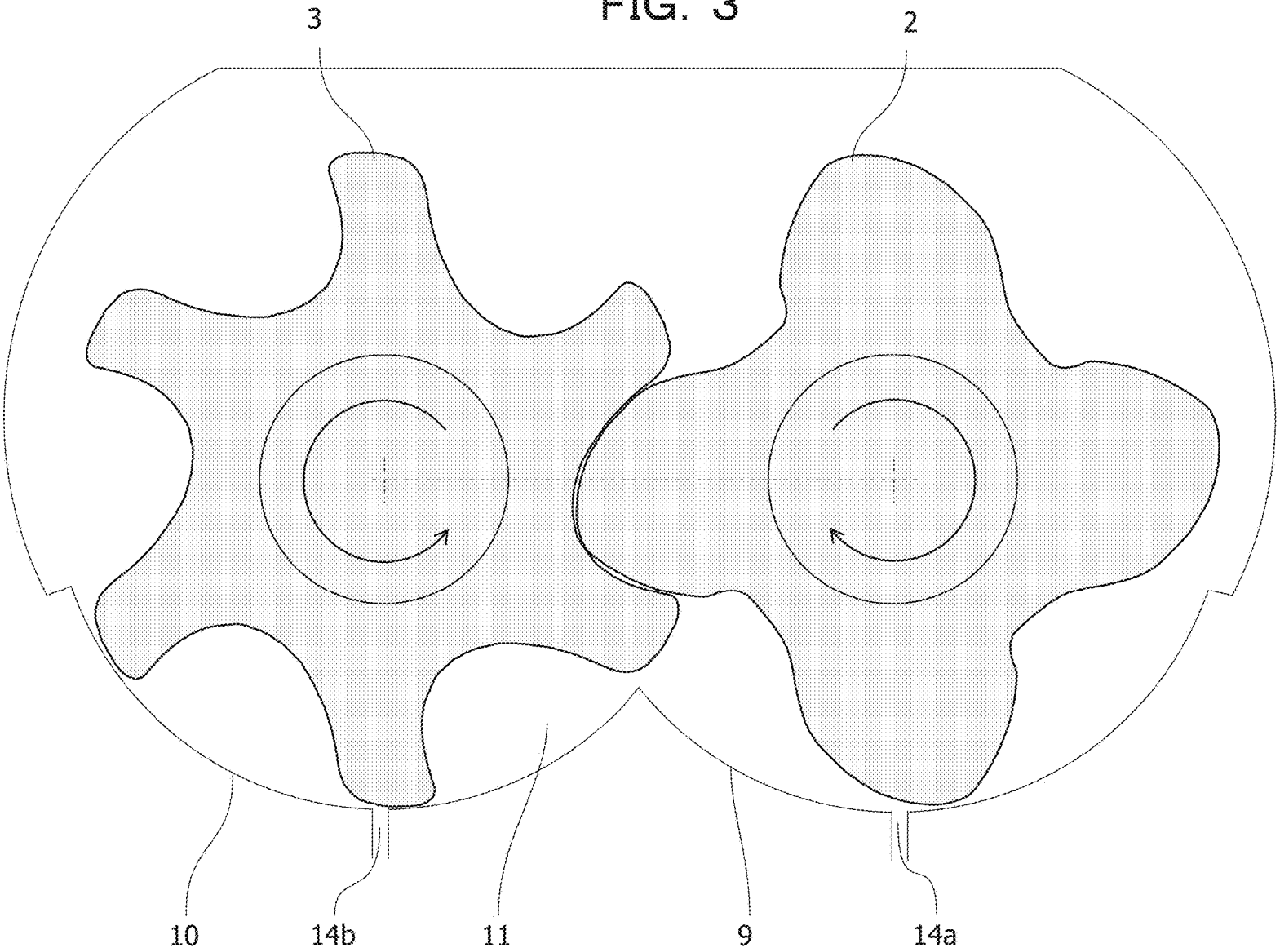
FIG. 3 is a cross-sectional view taken along the line A-A of FIG. 1.

Prior to the description of the embodiments, an overall configuration of a screw compressor will be described. FIGS. 2 and 3 show the configuration of the screw compressor. FIG. 2 is a configuration diagram of the screw compressor and FIG. 3 is a cross-sectional view taken along the line A-A of FIG. 2.

A screw compressor 1 includes a screw rotor which includes a male screw rotor 2 and a female screw rotor 3 having twisted teeth (robes) and rotating by meshing with each other, a casing 4 which accommodates the screw rotors, a suction side bearing 5 and a discharge side bearing 6 which respectively support the male and female screw rotors to be rotatable, and a shaft sealing component 7 such as an oil seal or a mechanical seal.

In general, the male screw rotor 2 is connected to a motor 8 which is a rotation drive source via a screw rotor shaft at the suction side end. Further, the male screw rotor 2 and the female screw rotor 3 are respectively accommodated with a gap of several tens to several hundreds μm with respect to a male side bore 9 and a female side bore 10 of the casing 4.

Here, the axial direction of the screw rotor is a direction indicated by the E direction of FIG. 2.

The male screw rotor 2 which is driven to rotate by the motor 8 drives the female screw rotor 3 to rotate and an operating space 11 formed by the tooth groove of both male and female screw rotors and the male side bore 9 and the female side bore 10 surrounding the groove is expanded and contracted so that a fluid such as air is sucked from a suction port 12, compressed to a predetermined pressure, and then discharged from a discharge flow path 13.

Further, a liquid is injected from the outside of the screw compressor 1 to the operating space 11, the suction side bearing 5, the discharge side bearing 6, and the shaft sealing component 7 through a liquid feed port 14, a suction side bearing liquid feed port 15, and a discharge side bearing liquid feed port 16.

In FIG. 3, reference numeral 14*a* indicates a liquid feed port of the male side bore, and reference numeral 14*b* indicates a liquid feed port of the female side bore.

Figure 4:
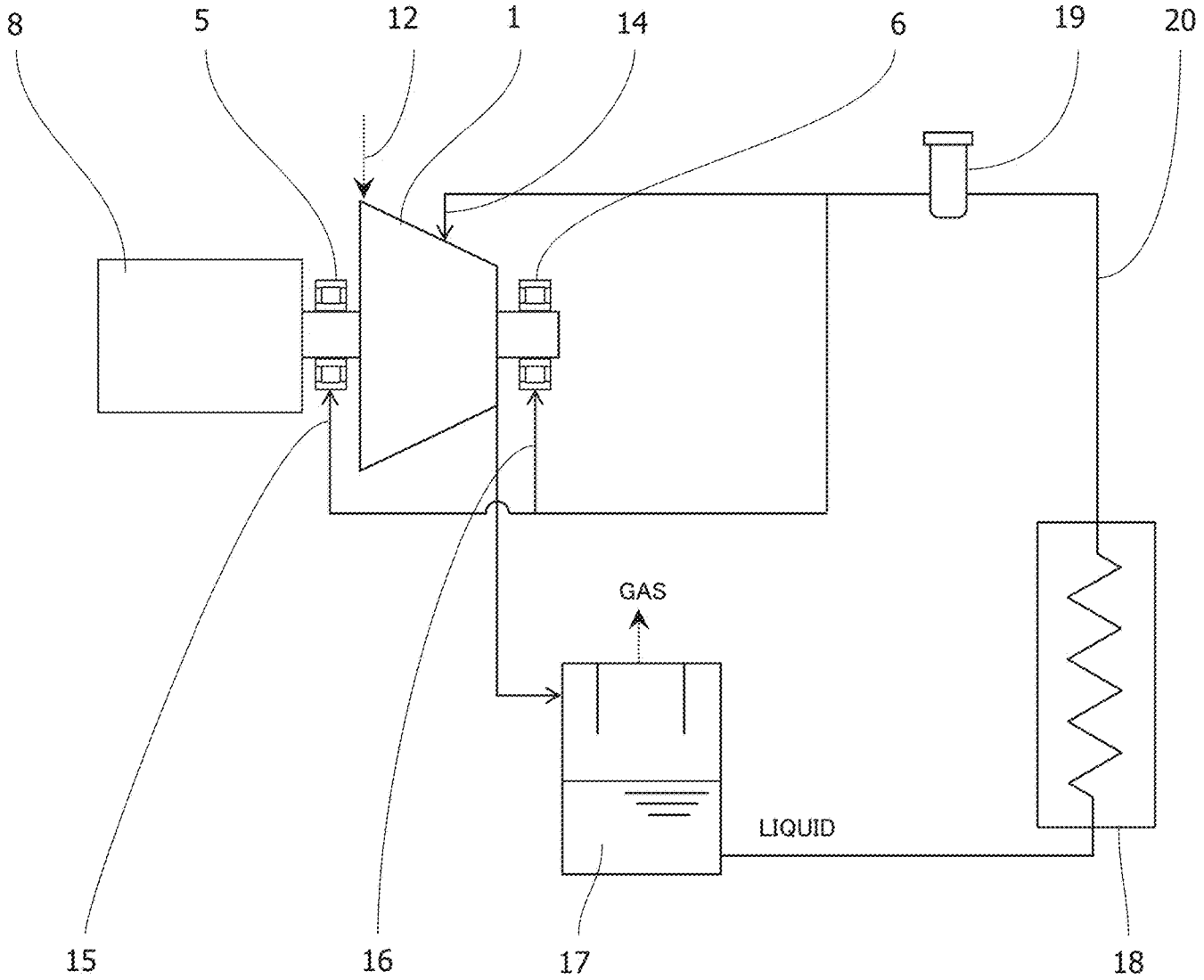
FIG. 4 is a diagram showing an oil feeding path of a general screw compressor.

FIG. 4 shows an external path of the liquid fed to the screw compressor 1. The liquid path is composed of the screw compressor 1, a centrifuge 17, a cooler 18, auxiliary machines 19 such as a filter and a check valve, and a pipe 20 connecting them.

A liquid such as oil or water injected from the outside is mixed in the compressed gas discharged from the screw compressor 1. The liquid mixed in the compressed gas is separated from the compressed gas by the centrifuge 17, cooled by the cooler 18, and branched through the auxiliary machines 19 so that the liquid is fed again from the liquid feed port 14 to the operating space 11 in the screw compressor 1, from the suction side bearing liquid feed port 15 to the suction side bearing 5, and from the discharge side bearing liquid feed port 16 to the discharge side bearing 6.

Additionally, the branch point of the liquid path is not limited to the outside of the screw compressor 1 as shown in FIG. 4, but includes the branch point inside the casing 4 of the screw compressor 1.

This embodiment expands the installable range of the liquid feed port in such a screw compressor in order to provide the screw compressor with high energy-saving performance by obtaining effects such as reduction of stirring loss and increase of cooling efficiency.

The screw rotors of FIGS. 2 and 3 show a general screw rotor in which the pitch corresponding to the distance between the lobes of the screw rotor does not change. The embodiments are common to FIGS. 2 and 3 except for the screw rotor. However, the screw rotor is different for each embodiment, and the pitch also changes from the suction end surface to the discharge end surface.

Here, the suction end surface is the end surface of the female or male screw rotor on the side of the suction port 12 in FIG. 2. Further, the discharge end surface is the end surface of the female or male screw rotor on the side of the discharge flow path 13 in FIG. 2.

First Embodiment

A first embodiment will be described with reference to FIGS. 1, 2, 3, 5, 6, and 15. Further, this embodiment relates to a liquid feed type screw air compressor. In the description of this embodiment, the same parts as described above will be described with the same reference numerals.

Figure 1:
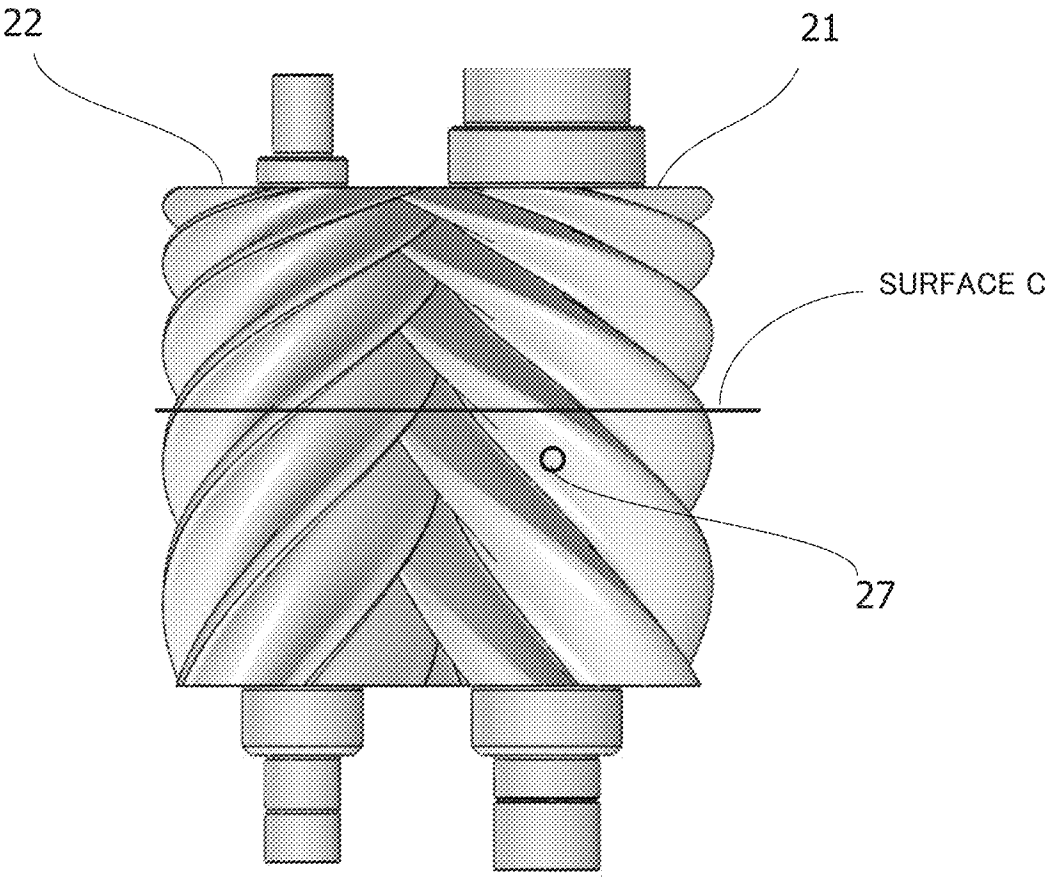
FIG. 1 is a side view of a screw rotor of a first embodiment.

In this embodiment, the male screw rotor 2 and the female screw rotor 3 shown in FIG. 3 are respectively a male screw rotor 21 having a changing pitch and a female screw rotor 22 having a changing pitch shown in FIG. 1 and a drill hole liquid feed port 27 is installed on the discharge end surface side in relation to the surface C shown in FIG. 1. The male screw rotor 21 having a changing pitch and the female screw rotor 22 having a changing pitch are screw rotors whose pitches increase from the suction end surface toward the discharge end surface, that is, in the axial direction of the screw rotor.

Figure 5:
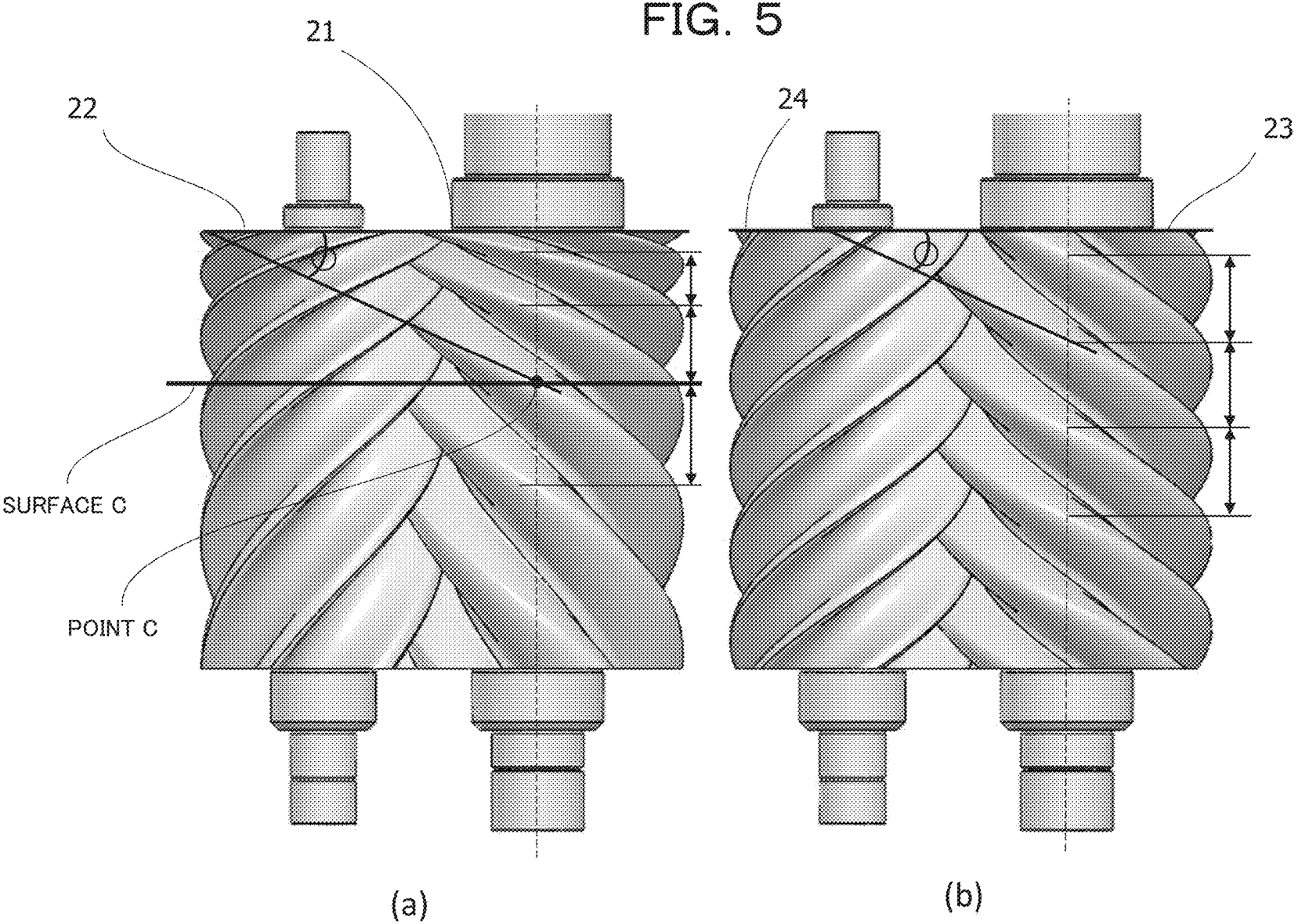
FIG. 5(*a*) is a side view of a screw rotor having a changing pitch of the first embodiment and FIG. 5(*b*) is a side view of a screw rotor having an equal pitch and having a cross-sectional shape orthogonal to the axial direction of the screw rotor and the like which are the same as those of the screw rotor of FIG. 5(*a*).

FIG. 5(*a*) is a diagram showing the male screw rotor 21 having a changing pitch and the female screw rotor 22 having a changing pitch in the direction B in FIG. 2, where the upper side is the suction end surface and the lower side is the discharge end surface. In order to compare the screw rotor of this embodiment with the conventional screw rotor, FIG. 5(*b*) shows a male screw rotor 23 having an equal pitch and a female screw rotor 24 having an equal pitch in the direction B of FIG. 2.

However, the male screw rotor 23 having an equal pitch is defined as a screw rotor having a shape and a dimension of a cross-section orthogonal to a screw rotor shaft, a screw rotor length, and a total winding angle which are the same as those of the male screw rotor 21 having a changing pitch and having a pitch not changing from the suction end surface toward the discharge end surface.

The female screw rotor 24 having an equal pitch is defined as a screw rotor having a shape and a dimension of a cross-section orthogonal to a screw rotor shaft, a screw rotor length, and a total winding angle which are the same as those of the female screw rotor 22 having a changing pitch and having a pitch not changing from the suction end surface toward the discharge end surface.

In this way, the relationship between male and female screw rotors having an equal pitch and male and female screw rotors having a changing pitch is defined. This is to describe the expanding of the installable range of the oil feed port when using the screw rotor having a changing pitch compared to the screw rotor having an equal pitch used in the conventional liquid feed type screw rotor under the above-described substantially same conditions.

Here, in order to define the surface C, an acute angle formed by the peak line at a certain point of the screw rotor tooth tip and the surface parallel to the end surface of the screw rotor is defined as the helix angle. A point C is a point in which the helix angle of the male screw rotor 23 having an equal pitch and the helix angle of the male screw rotor 21 having a changing pitch are the same. Further, a surface including the point C and parallel to the end surface of the screw rotor is defined as a surface C.

Figure 6:
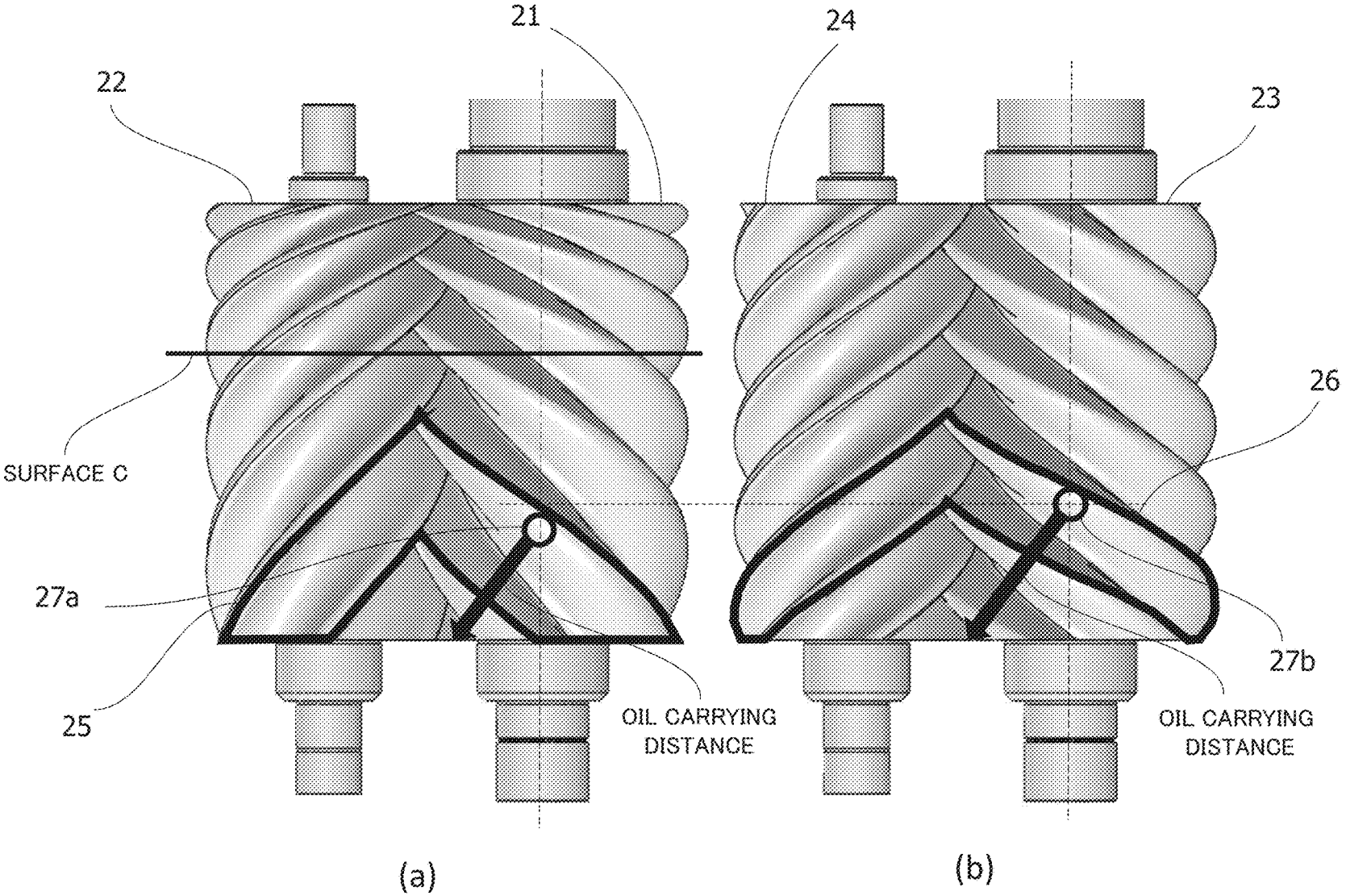
FIG. 6(*a*) is a side view of a screw rotor having a changing pitch of the first embodiment and having a rotation angle different from that of FIG. 5 and FIG. 6(*b*) is a side view of a screw rotor having an equal pitch and having a cross-sectional shape orthogonal to the axial direction of the screw rotor and the like which are the same as those of the screw rotor of FIG. 6(*a*).

The actions and effects of this embodiment will be described with reference to FIG. 6. FIG. 6(*a*) shows the male screw rotor 21 having a changing pitch and the female screw rotor 22 having a changing pitch of this embodiment in the direction B of FIG. 2. FIG. 6(*b*) shows the male screw rotor 23 having an equal pitch and the female screw rotor 24 having an equal pitch in the direction B of FIG. 2. FIG. 6 shows a screw rotor of which a rotation angle is different from that of FIG. 5.

Here, the operating chamber volume is obtained by the product of the axial length of the operating chamber and the groove area of the screw rotor cross-section orthogonal to the axial direction of the screw rotor, but since the screw rotor of FIG. 6(*a*) and the screw rotor of FIG. 6(*b*) have the same cross-sectional shape orthogonal to the axial direction, the volume of the operating chamber is the same if the axial length of the operating chamber is the same.

Since an operating chamber 25 of FIG. 6(*a*) and an operating chamber 26 of FIG. 6(*b*) have the same axial length and the same volume, the same flow rate of liquid can be fed to both the operating chamber 25 and the operating chamber 26 when the same liquid feed mechanism is used even when the liquid feed port communicates with any screw rotor specification operating chamber if the operating chamber pressure is the same. Here, the axial gap of the robe peak lines forming the operating chamber 25 is wider than the axial gap of the robe peak lines forming the operating chamber 26 and a region on the inner wall surface of the bore through which the liquid feed port can communicate is wider in the operating chamber 25 than in the operating chamber 26.

Figure 15:
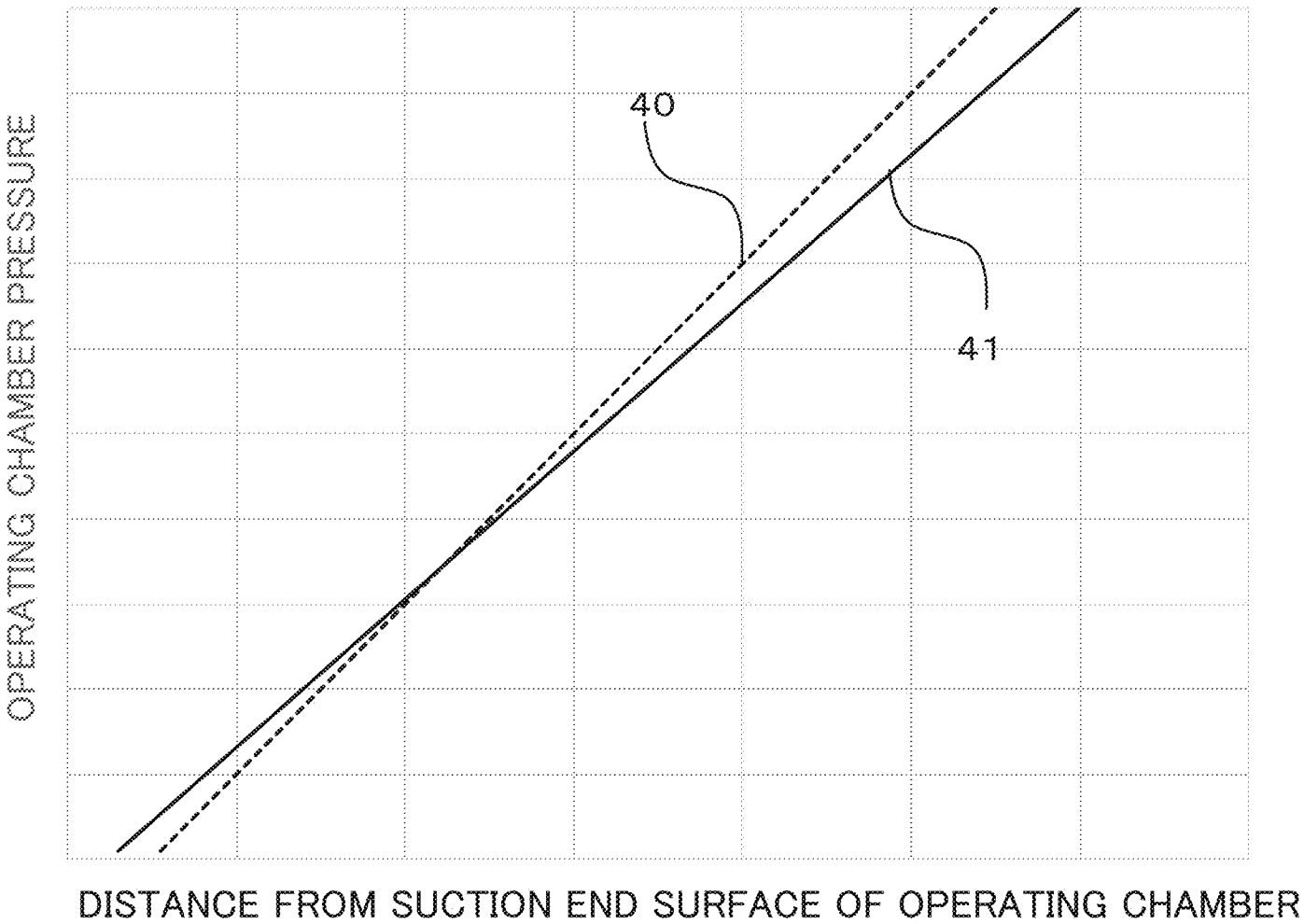
FIG. 15 is a graph showing a relationship between a pressure and a distance from a suction end surface of an operating chamber of the first embodiment.

Further, FIG. 15 shows a graph of an operating chamber pressure 41 of a screw rotor having a pitch increasing from the suction end surface toward the discharge end surface and an operating chamber pressure 40 of a screw rotor having an equal pitch when the horizontal axis indicates the axial distance from the suction end surface of the operating chamber and the vertical axis indicates the pressure of the operating chamber. Here, the axial distance from the suction end surface of the operating chamber is set to the position on the male screw rotor shaft of the peak line on the suction end surface side of the robe peak lines forming the operating chamber.

In the latter half of the compression stroke (the upper side of the graph), when comparing the operating chambers at the same pressure, it can be seen that the screw rotor having a changing pitch is closer to the discharge end surface side than the screw rotor having an equal pitch and the liquid feed port can be installed to a range closer to the discharge end surface.

That is, as understood from the graph of FIG. 15, when the pitch of the screw rotor increases from the suction end surface toward the discharge end surface, the installable range can be expanded by disposing the liquid feed mechanism on the discharge end surface side compared to the screw rotor having an equal pitch. Here, the discharge end surface side is the right side of FIG. 15.

In FIG. 15, the position in the horizontal axis (the distance from the suction end surface of the operating chamber) at the point formed by intersecting the line graph of the screw rotor having an equal pitch and the line graph of the screw rotor having a pitch increasing from the suction end surface toward the discharge end surface corresponds to the point C of FIG. 5.

This is a range in which the line graph on the right side of point C, that is, the screw rotor having an equal pitch exceeds the line graph of the screw rotor having a pitch increasing from the suction end surface toward the discharge end surface with respect to the operating chamber pressure (vertical axis).

That range is a range in which the screw rotor having an equal pitch and having a shape and a dimension of a cross-section orthogonal to the axial direction of the screw rotor, a total winding angle, and a length which are the same as those of the screw rotor having a pitch increasing from the suction end surface toward the discharge end surface has a pressure of the operating chamber at a certain position becoming higher than the pressure of the operating chamber at the same position as the screw rotor having a pitch increasing from the suction end surface toward the discharge end surface.

When the liquid feed mechanism is disposed in such a range, the installable range of the liquid feed mechanism can be expanded compared to the case of using the screw rotor having an equal pitch.

A method of determining the arrangement of the liquid feed mechanism can be obtained by acquiring the data of FIG. 15 in terms of a simulation or experiment. That is, when the pitch of the screw rotor increases from the suction end surface toward the discharge end surface, a range is obtained in which the pressure of the operating chamber in the screw rotor having an equal pitch and having a shape and a dimension of a cross-section orthogonal to the axial direction of the rotor, a total winding angle, and a length which are the same as the screw rotor having a changing pitch becomes higher than the pressure of the operating chamber of the screw rotor having a pitch increasing from the suction end surface toward the discharge end surface and the liquid feed mechanism is disposed in that obtained range.

According to the first embodiment, as shown in FIG. 6, a range in which a region on the inner wall surface of the bore allowing the liquid feed port to communicate with the operating chamber 25 becomes wider than the case of allowing the oil feed port to communicate with the operating chamber 26 is on the discharge end surface side in relation to the surface C of the male screw rotor 21 having a changing pitch and the female screw rotor 22 having a changing pitch. Therefore, when the liquid feed port can be installed on the discharge end surface side in relation to the surface C, the installable range of the liquid feed port can be expanded.

Further, the distance between the discharge port and the oil feed port 27*a* communicating with the operating chamber 25 can be shorter than the distance between the discharge port and the liquid feed port 27*b* communicating with the operating chamber 26 in the installable range of the liquid feed port as shown in FIG. 6, the distance of carrying the liquid by the screw rotor is shortened, and stirring loss can be reduced.

In this embodiment, the screw rotor in which the pitch changes continuously and uniformly is used, but the change in pitch may be gradual or the rate of change in pitch may change in the middle.

If there are multiple points in which the helix angle of the screw rotor having a changing pitch in this embodiment is the same as the helix angle of the assumed screw rotor having an equal pitch, the point closest to the suction end surface may be set as the point C and the liquid feed port may be installed on the discharge end surface side of the surface parallel to the suction or discharge end surface including the point C.

Further, although a single liquid feed port is installed in this embodiment, a plurality of liquid feed ports may be installed.

Second Embodiment

A second embodiment will be described with reference to FIGS. 3, 7, 8, 9, and 10. Additionally, this embodiment relates to the liquid feed type screw compressor similarly to the first embodiment and the same parts as in the first embodiment will be described with the same reference numerals.

Figure 7:
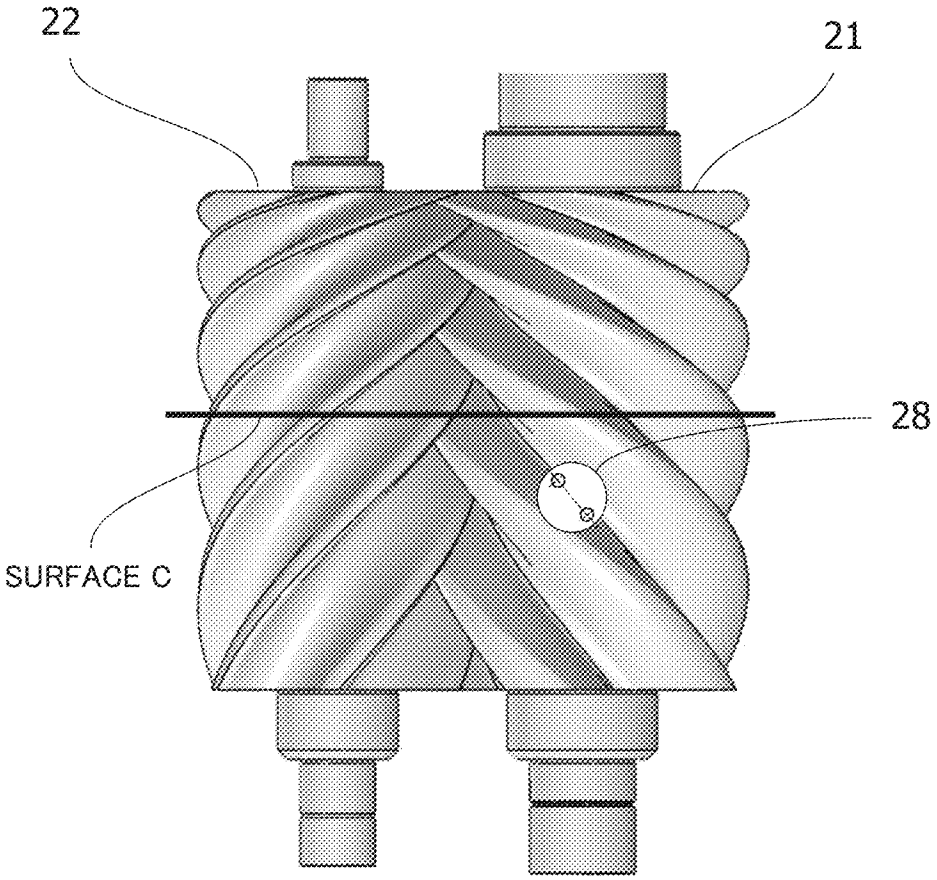
FIG. 7 is a side view of a screw rotor of a second embodiment.

In this embodiment, the male screw rotor 2 and the female screw rotor 3 shown in FIG. 3 are respectively the male screw rotor 21 having a changing pitch and the female screw rotor 22 having a changing pitch and a jet collision nozzle 28 is installed on the discharge end surface side in relation to the surface C as shown in FIG. 7.

Figure 8:
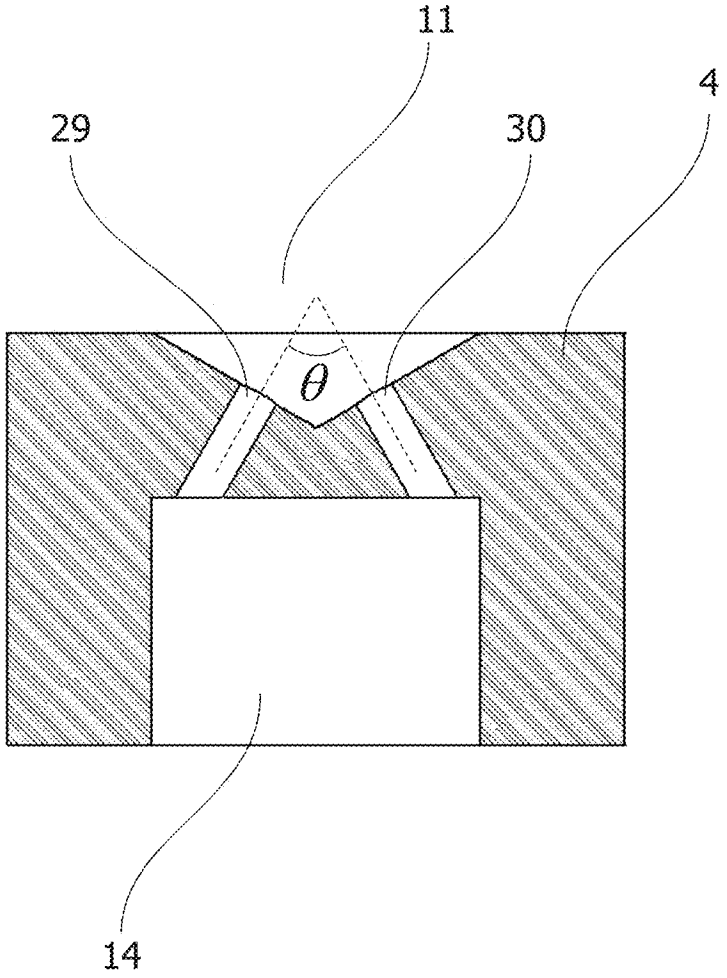
FIG. 8 is a cross-sectional view of a liquid feed nozzle of the second embodiment.

The jet collision nozzle will be described with reference to FIG. 8. FIG. 8 shows a cross-sectional view of the jet collision nozzle. A first injection port 29 and a second injection port 30 having an opening diameter smaller than that of the liquid feed port 14 are connected to the end portion of the liquid feed port 14 while being inclined by an angle θ and the first injection port 29 and the second injection port 30 communicate with the operating space 11.

The first injection port 29 and the second injection port 30 intersect on the side of the operating space 11 and the intersecting point is located on the tooth groove of the screw rotor. The liquid flows from the liquid feed port 14 to be injected into the first injection port 29 and the second injection port 30 and the liquids collide with each other to be diffused.

By the diffusion of the liquid, the liquid is widely diffused in the operating chamber and hence a high cooling effect can be obtained. On the other hand, the jet collision nozzle has a large pressure loss when feeding a liquid and feeds a smaller amount of liquid from a single jet collision nozzle than the drill hole. In order to ensure the liquid feeding amount, the number of the installed liquid feed ports needs to be increased. However, the installable range of the liquid feed port is limited by a pressure difference between the main liquid feeding pressure and the pressure of the operating chamber communicating with the liquid feed port or the size of the compressor.

Similar to the first embodiment, this embodiment can expand the installable range of the liquid feed port and can reduce stirring loss. In addition, since the installable range of the liquid feed port is expanded, more liquid feed ports can be installed compared to the related art. Accordingly, a sufficient liquid feeding amount can be ensured even when the jet collision nozzle is used.

Furthermore, in the screw compressor using the male screw rotor 21 having a changing pitch and the female screw rotor 22 having a changing pitch, the gap of the robe peak lines forming an arbitrary operating chamber on the discharge end surface side in relation to the surface C is wider than that of the case of using the male screw rotor 23 having an equal pitch and the female screw rotor 24 having an equal pitch. Therefore, the liquid fed from the fine liquid feed port is widely diffused and hence a higher cooling effect can be obtained.

Figure 10:
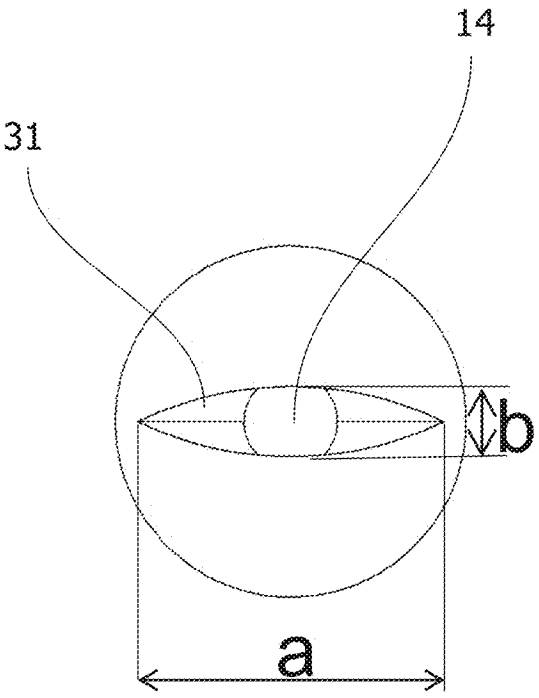
FIG. 10 is a diagram showing a connection portion between a slit portion and an operating space of the second embodiment.

The invention is not limited to the jet collision nozzle and the same effect can be obtained by a liquid feed mechanism or a fine liquid feed mechanism including a fan spray nozzle shown in FIG. 10 and widely diffusing a liquid.

Figure 9:
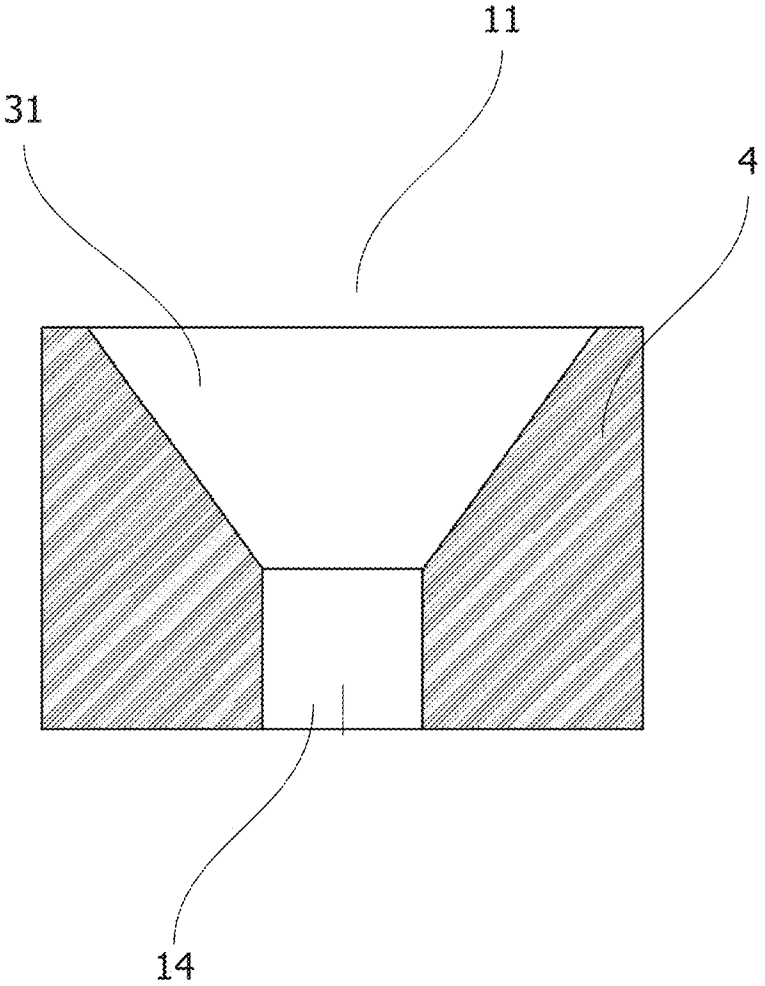
FIG. 9 is a cross-sectional view of the liquid feed nozzle of the second embodiment.

The fan spray nozzle will be described with reference to the cross-sectional view of FIG. 9. The liquid flowing into the liquid feed port 14 flows into the operating space 11 through a slit portion 31. FIG. 10 shows a connection portion between the slit portion 31 and the operating space 11. The slit portion 31 has a shape in which a dimension a of a slit in the longitudinal direction is longer than a dimension b thereof in the width direction.

The liquid injected the slit portion 31 into the operating space 11 is widely diffused in the direction of the dimension a (the longitudinal direction of the slit) compared to the direction of the dimension b (the width direction of the slit). The liquid is injected from the slit portion 31 in the form of a film and then atomized.

In this embodiment, one fine liquid feed port such as a jet collision nozzle or a fan spray nozzle is installed, but a plurality of liquid feed ports may be installed in the axial direction of the screw rotor. That is, at least one or more fine liquid feed ports and at least one or more drill hole liquid feed ports may be installed in one compressor. For example, when a space capable of installing a plurality of fine liquid feed ports cannot be ensured in a small compressor, the drill hole liquid feed port is installed on the suction end surface side and the fine liquid feed port is installed on the discharge end surface side. Accordingly, it is possible to obtain a high cooling effect by feeding a fine liquid while ensuring a liquid amount necessary for lubricating the screw rotor.

Third Embodiment

A configuration of this embodiment will be described with reference to FIGS. 2, 3, 11, 13, and 16. Further, the same parts as described above will be described with the same reference numerals.

Figure 13:
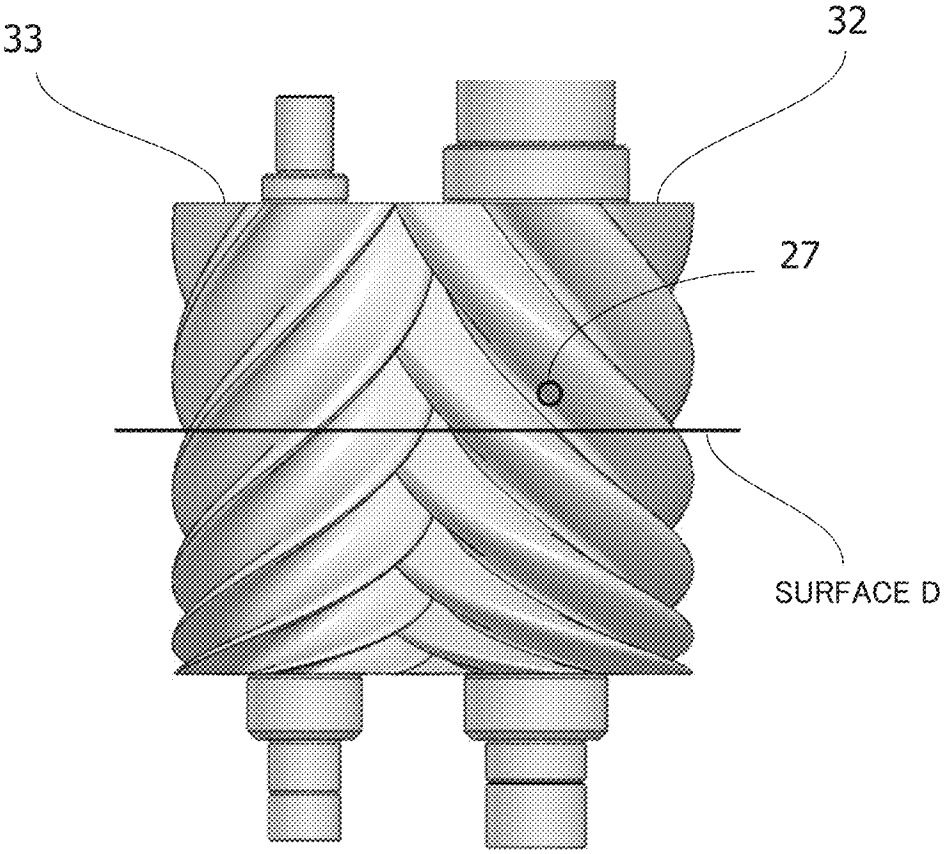
FIG. 13 is a side view of the screw rotor having a changing pitch of the third embodiment.

In this embodiment, the male screw rotor 2 and the female screw rotor 3 shown in FIG. 3 are respectively a male screw rotor 32 having a changing pitch and a female screw rotor 33 having a changing pitch shown in FIG. 13 and the drill hole liquid feed port 27 is installed on the suction end surface side in relation to the surface D shown in FIG. 13.

The male screw rotor 32 having a changing pitch and the female screw rotor 33 having a changing pitch are the screw rotors having a pitch decreasing from the suction end surface toward the discharge end surface.

Figure 11:
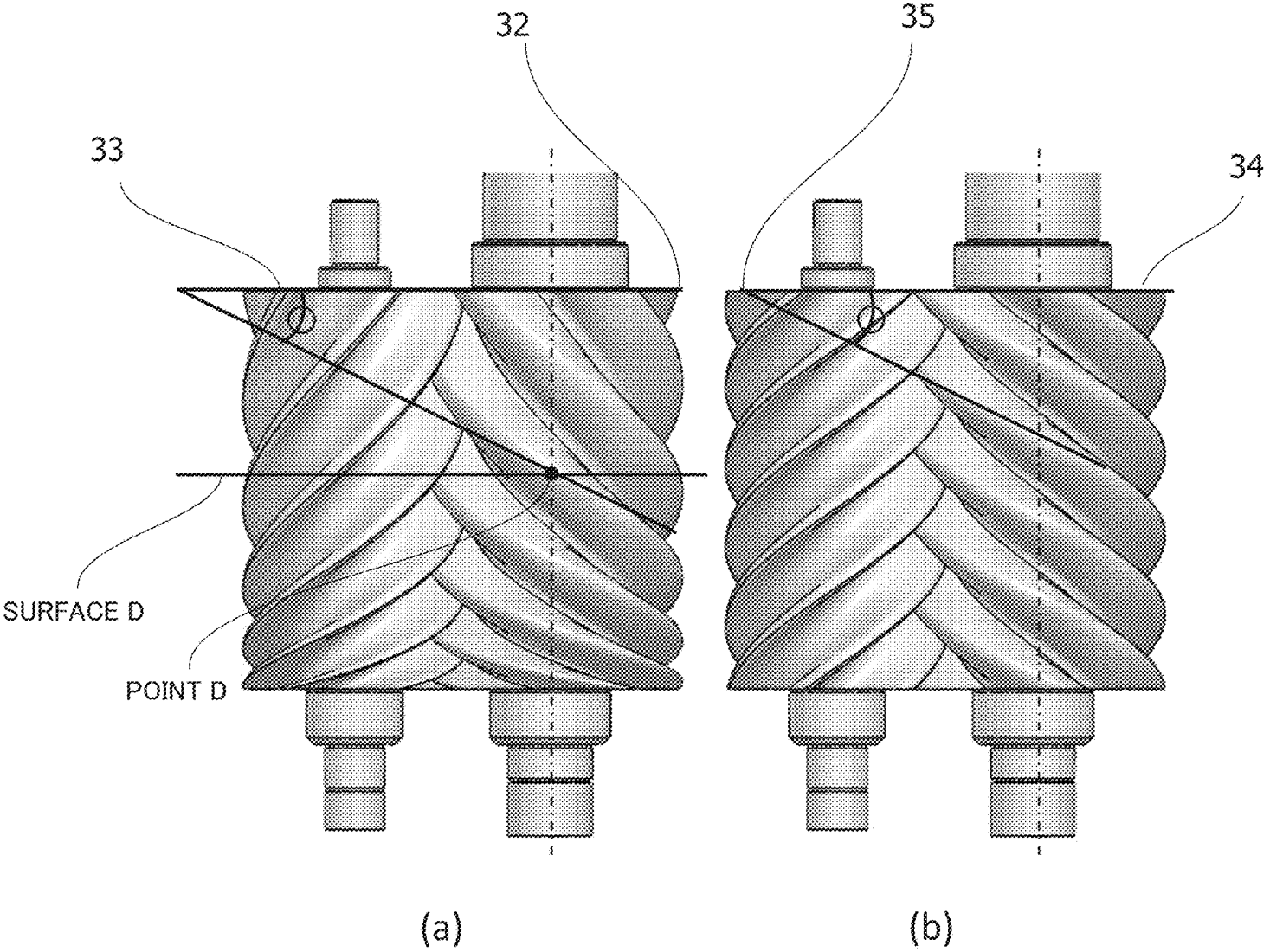
FIG. 11(*a*) is a side view of a screw rotor having a changing pitch of a third embodiment and FIG. 11(*b*) is a side view of a screw rotor having an equal pitch and having a cross-sectional shape orthogonal to the axial direction of the screw rotor and the like which are the same as those of the screw rotor of FIG. 11(*a*).

FIG. 11(*a*) shows the male screw rotor 32 having a changing pitch and the female screw rotor 33 having a changing pitch in the direction B of FIG. 2, where the upper side of FIG. 11 is the suction end surface and the lower side is the discharge end surface.

FIG. 11(*b*) shows a male screw rotor 34 having an equal pitch and a female screw rotor 35 having an equal pitch in the direction B of FIG. 2. However, the male screw rotor 34 having an equal pitch is defined as a screw rotor which is the same as the male screw rotor 32 having a changing pitch in the shape and the dimension of the cross-section orthogonal to the screw rotor shaft, the screw rotor length, and the total winding angle and has a pitch not changing from the suction end surface toward the discharge end surface.

The female screw rotor 35 having an equal pitch is defined as a screw rotor which is the same as the female screw rotor 33 having a changing pitch in the shape and the dimension of the cross-section orthogonal to the screw rotor shaft, the screw rotor length, and the total winding angle and has a pitch not changing from the suction end surface toward the discharge end surface.

Further, a point D is a point in which the helix angle of the male screw rotor 34 having an equal pitch and the helix angle of the male screw rotor 32 having a changing pitch are the same and a surface including the point D and parallel to the end surface of the screw rotor is defined as a surface D.

Figure 12:
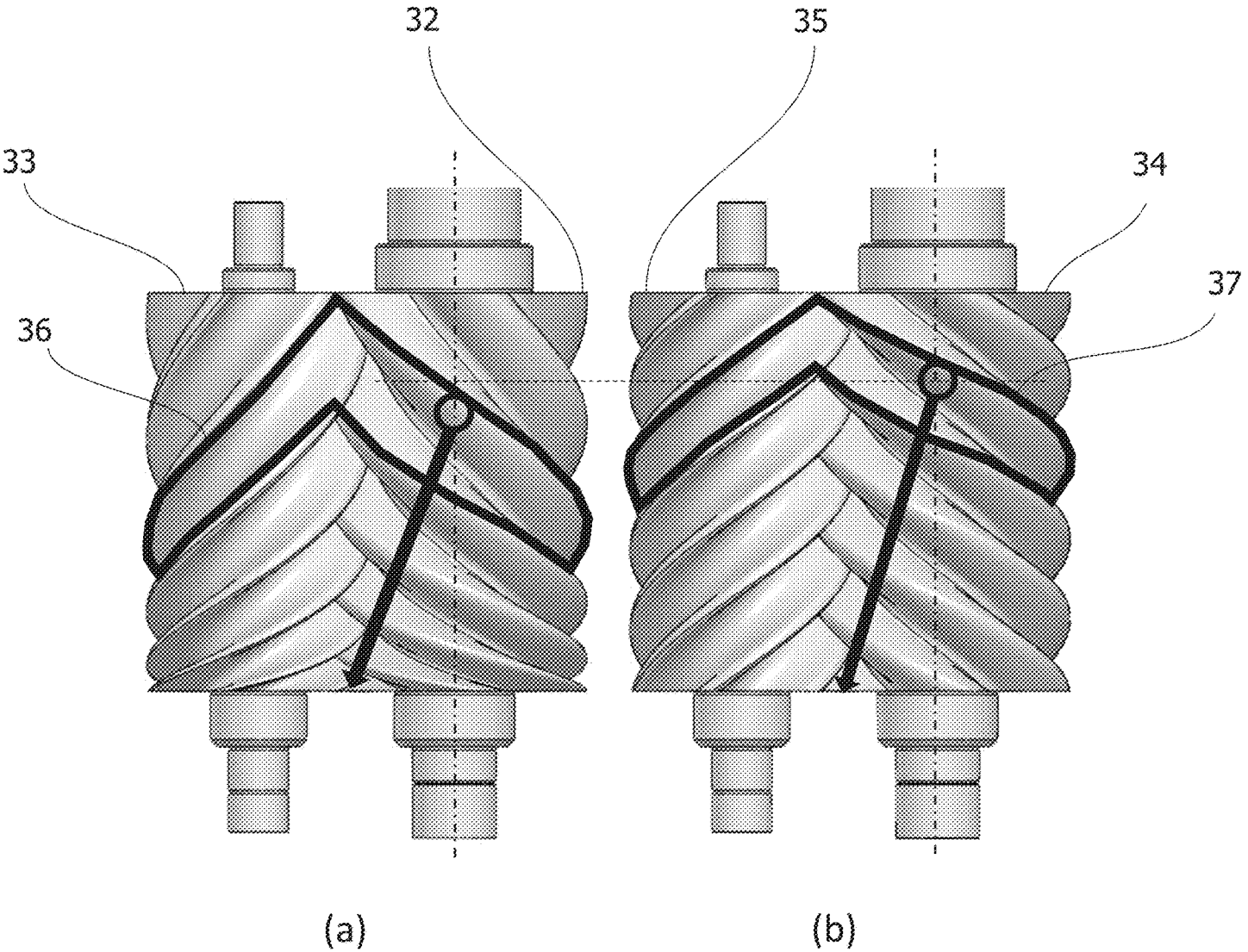
FIG. 12(*a*) is a side view of a screw rotor having a changing pitch of the third embodiment and having a rotation angle different from that of FIG. 11 and FIG. 12(*b*) is a side view of a screw rotor having an equal pitch and having a cross-sectional shape orthogonal to the axial direction of the screw rotor and the like which are the same as those of the screw rotor of FIG. 12(*a*).

The actions and effects of this embodiment will be described with reference to FIG. 12. FIG. 12(*a*) shows the male screw rotor 32 having a changing pitch and the female screw rotor 33 having a changing pitch in the direction B of FIG. 2. FIG. 12(*b*) shows the male screw rotor 34 having an equal pitch and the female screw rotor 35 having an equal pitch in the direction B of FIG. 2. FIG. 12 shows a screw rotor having a rotation angle different from that of FIG. 11.

Since the operating chamber 36 and the operating chamber 37 have the same volume, the same flow rate of liquid can be fed to both the operating chamber 36 and the operating chamber 37 when the same liquid feed mechanism is used even when the liquid feed port communicates with any operating chamber if the pressure is the same.

Here, since the axial gap of the robe peak lines forming the operating chamber 36 is wider than the axial gap of the robe peak lines forming the operating chamber 37, the operating chamber 36 is wider than the operating chamber 37 in a region on the inner wall surface of the bore allowing the communication with the liquid feed port.

Figure 16:
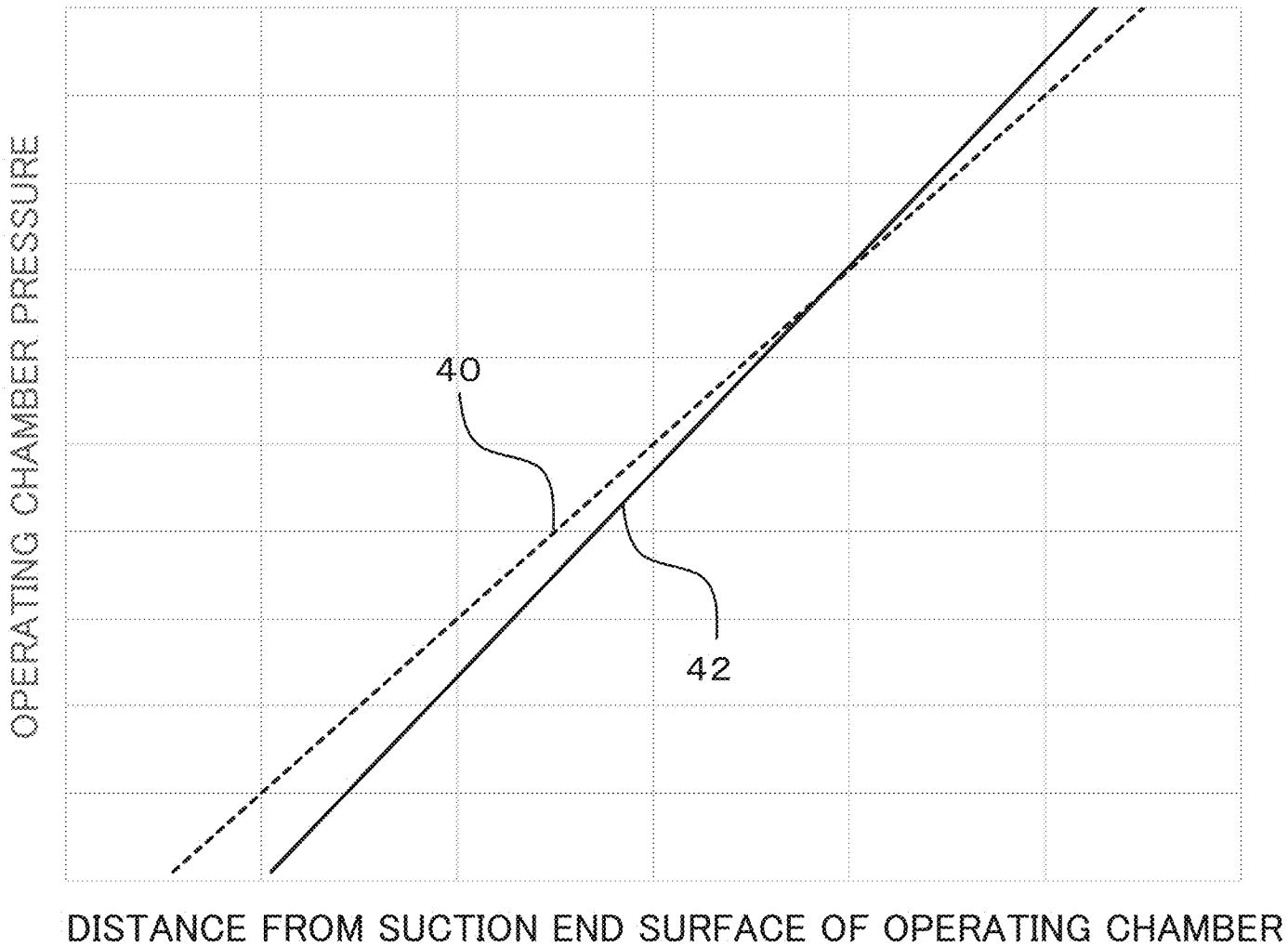
FIG. 16 is a graph showing a relationship between a pressure and a distance from a suction end surface of an operating chamber of the third embodiment.

Further, FIG. 16 shows a graph of an operating chamber pressure 42 of a screw rotor having a pitch decreasing from the suction end surface toward the discharge end surface and an operating chamber pressure 40 of a screw rotor having an equal pitch when the horizontal axis indicates the axial distance from the suction end surface of the operating chamber and the vertical axis indicates the pressure of the operating chamber.

Here, the axial distance from the suction end surface of the operating chamber is set to the position on the screw rotor shaft of the peak line on the suction end surface side of the robe peak lines forming the operating chamber. From this graph, in the first half of the compression stroke (the lower side of the graph), when comparing the operating chambers at the same pressure, it can be seen that the operating chamber position of the screw rotor having a changing pitch can be closer to the discharge end surface side than the screw rotor having an equal pitch, that is, the liquid feed port can be installed to a range closer to the discharge end surface.

That is, as understood from the graph of FIG. 16, when the pitch of the screw rotor decreases from the suction end surface toward the discharge end surface, the installable range can be expanded by disposing the liquid feed mechanism on the suction end surface side compared to the screw rotor having an equal pitch. Here, the suction end surface side is the left side of FIG. 16.

In FIG. 16, the position in the horizontal axis (the distance from the suction end surface of the operating chamber) at the point formed by intersecting the line graph of the screw rotor having an equal pitch and the line graph of the screw rotor having a pitch increasing from the suction end surface toward the discharge end surface corresponds to the point D of FIG. 11.

This is a range in which the line graph on the left side of point D, that is, the screw rotor having an equal pitch exceeds the line graph of the screw rotor having a pitch decreasing from the suction end surface toward the discharge end surface with respect to the operating chamber pressure (vertical axis).

That range is a range in which the screw rotor having an equal pitch and having a shape and a dimension of a cross-section orthogonal to the axial direction of the screw rotor, a total winding angle, and a screw rotor length which are the same as those of the screw rotor having a pitch decreasing from the suction end surface toward the discharge end surface has a pressure of the operating chamber at a certain position becoming higher than the pressure of the operating chamber at the same position as the screw rotor having a pitch decreasing from the suction end surface toward the discharge end surface. When the liquid feed mechanism is disposed in such a range, the installable range of the liquid feed mechanism can be expanded compared to the case of using the screw rotor having an equal pitch.

A method of determining the arrangement of the liquid feed mechanism can be obtained by acquiring the data of FIG. 16 in terms of a simulation or experiment. That is, when the pitch of the screw rotor decreases from the suction end surface toward the discharge end surface, a range is obtained in which the pressure of the operating chamber in the screw rotor having an equal pitch and having a shape and a dimension of a cross-section orthogonal to the axial direction of the rotor, a total winding angle, and a length which are the same as the screw rotor having a changing pitch becomes higher than the pressure of the operating chamber of the screw rotor having a pitch decreasing from the suction end surface toward the discharge end surface and the liquid feed mechanism is disposed in that obtained range.

According to the third embodiment, as shown in FIG. 12, a range in which a region on the inner wall surface of the bore allowing the liquid feed port to communicate with the operating chamber 36 becomes wider than that of the case communicating with the operating chamber 37 is the suction end surface side in relation to the surface D. Therefore, when the liquid feed port is installed on the suction end surface side in relation to the surface D, it is possible to expand the installable range of the liquid feed port.

Further, in the installable range of the liquid feed port, the distance between the discharge port and the oil feed port communicating with the operating chamber 36 can be made shorter than the distance between the discharge port and the oil feed port communicating with the operating chamber 37 as indicated by an arrow of FIG. 12. Therefore, it is possible to shorten a distance in which the screw rotor carries the liquid and reduce stirring loss.

Although a single liquid feed port is installed in this embodiment, a plurality of liquid feed ports may be installed.

If there are multiple points in which the helix angle of the screw rotor having a changing pitch in this embodiment is the same as the helix angle of the assumed screw rotor having an equal pitch, the point closest to the suction end surface may be set as the point D and the liquid feed port may be installed on the suction end surface side of the surface parallel to the suction or discharge end surface including the point D.

Fourth Embodiment

This embodiment will be described with reference to FIG. 14. Additionally, this embodiment relates to the liquid feed type screw compressor similarly to the third embodiment and the same parts as in the third embodiment will be described with the same reference numerals.

Figure 14:
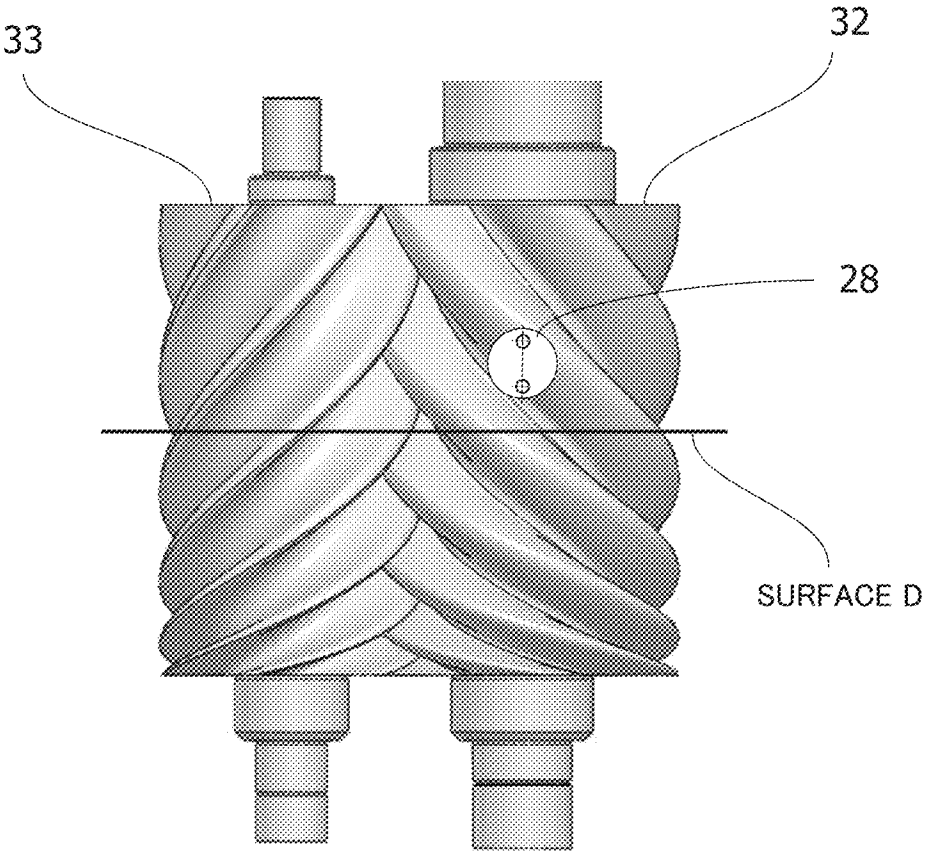
FIG. 14 is a side view of a screw rotor having a changing pitch of a fourth embodiment.

In this embodiment, the male screw rotor 2 and the female screw rotor 3 shown in FIG. 3 are respectively the male screw rotor 32 having a changing pitch and the female screw rotor 33 having a changing pitch shown in FIG. 14. Then, the jet collision nozzle 28 is installed on the suction end surface side in relation to the surface D of FIG. 14.

The jet collision nozzle which is one of the fine liquid feed mechanisms adopted in this embodiment has a large pressure loss when feeding a liquid and has a smaller liquid feeding amount than that of the case of feeding the liquid using the drill hole when the differential pressure between the main liquid feeding pressure and the pressure of the operating chamber communicating with the liquid feed port is the same.

In the screw compressor using the male screw rotor 32 having a changing pitch and the female screw rotor 33 having a changing pitch of this embodiment, it is possible to expand a region having a low operating chamber pressure compared to the male screw rotor 34 having an equal pitch and the female screw rotor 35 having an equal pitch on the suction end surface side in relation to the surface D.

That is, it is possible to expand a region having a large difference between the main liquid feeding pressure and the pressure of the operating chamber communicating with the liquid feed port. Accordingly, it is possible to reduce the stirring loss similarly to the third embodiment and to obtain a high cooling effect by sufficiently ensuring the liquid feeding amount by the jet collision nozzle.

The invention is not limited to the jet collision nozzle and the same effect can be obtained by a liquid feed mechanism or a fine liquid feed mechanism including a fan spray nozzle shown in FIG. 10 and widely diffusing a liquid.

Although a single fine liquid feed port is installed in this embodiment, a plurality of liquid feed ports may be installed, a plurality of drill hole liquid feed ports may be installed, or a plurality of liquid feed ports may be installed by the combination of the drill hole liquid feed port and the fine liquid feed port.

REFERENCE SIGNS LIST

1 Screw compressor
4 Casing
21, 32 Male screw rotor with changing pitch
22, 33 Female screw rotor with changing pitch
27 Drill hole liquid feed port

The invention claimed is:

1. A screw compressor comprising:
a screw rotor;
a casing which accommodates the screw rotor; and
a liquid feed mechanism configured to feed a liquid into an operating chamber enclosed by the casing,
wherein a pitch of the screw rotor increases continuously in an axial direction from a suction end surface toward a discharge end surface.

2. The screw compressor according to claim 1,
wherein the liquid feed mechanism feeds a liquid to the screw rotor from a hole formed by penetrating the casing.

3. The screw compressor according to claim 1,
wherein the liquid feed mechanism is disposed on the discharge end surface side.

4. The screw compressor according to claim 1,
wherein the liquid feed mechanism is disposed at a position in which a pressure of the operating chamber communicating with a liquid feed port installed at a certain position of an inner wall of a bore in a screw rotor having an equal pitch and having a shape and a dimension of a cross-section orthogonal to the axial direction of the screw rotor, a total winding angle, and a length which are the same as those of the screw rotor becomes higher than a pressure of the operating chamber communicating with a liquid feed port installed at the same position as the screw rotor.

5. The screw compressor according to claim 1,
wherein the liquid feed mechanism is disposed on the discharge end surface in relation to a surface parallel to the suction end surface and the discharge end surface and including a point in which a helix angle of the screw rotor is the same as a helix angle of a screw rotor having an equal pitch and having a shape and a dimension of a cross-section orthogonal to the axial direction of the screw rotor, a total winding angle, and a length which are the same as those of the screw rotor.

6. The screw compressor according to claim 1,
wherein the liquid feed mechanism includes a fine liquid feed port.

7. The screw compressor according to claim 1, further comprising:
a plurality of liquid feed ports provided in the axial direction of the screw rotor.

8. The screw compressor according to claim 1,
wherein the liquid feed mechanism includes at least one or more fine liquid feed ports and at least one or more drill hole liquid feed ports.

9. The screw compressor according to claim 1,
wherein the liquid feed mechanism includes a jet collision nozzle or a fan spray nozzle.

* * * * *